US008418614B2

(12) United States Patent
Whitelaw et al.

(10) Patent No.: US 8,418,614 B2
(45) Date of Patent: Apr. 16, 2013

(54) METHOD AND CALIBRATION TOOL FOR CALIBRATING A ROTARY PRINTING PRESS

(75) Inventors: Gordon Whitelaw, Bilgola (AU); Wolfgang Brusdeilins, Bielefeld (DE)

(73) Assignee: Fischer & Krecke GmbH & Co. KG (DE)

( * ) Notice: Subject to any disclaimer, the term of this patent is extended or adjusted under 35 U.S.C. 154(b) by 1273 days.

(21) Appl. No.: 12/111,290

(22) Filed: Apr. 29, 2008

(65) Prior Publication Data

US 2009/0229480 A1 Sep. 17, 2009

(30) Foreign Application Priority Data

Mar. 13, 2008 (EP) ..... 08004685

(51) Int. Cl.
*B41F 13/12* (2006.01)
*B41J 29/38* (2006.01)

(52) U.S. Cl.
USPC ..... 101/485; 101/480; 101/248

(58) Field of Classification Search ..... 101/178, 101/181–185, 216–219, 247, 248, 483, 485; 492/9, 10; 33/657, 614, 615, 616, 617, 618, 33/619, 621, 620; *B41F 13/14, 13/26, 13/44*
See application file for complete search history.

(56) References Cited

U.S. PATENT DOCUMENTS 3,717,902 A * 2/1973 Savenije ..... 16/271
3,997,828 A * 12/1976 Bottcher et al. ..... 318/603
4,255,839 A * 3/1981 Shea ..... 29/274
4,290,353 A * 9/1981 Pav et al. ..... 100/162 B
4,484,522 A * 11/1984 Simeth ..... 101/248
5,178,678 A * 1/1993 Koehler et al. ..... 118/46
5,201,272 A * 4/1993 Simon ..... 101/485
5,562,027 A * 10/1996 Moore ..... 100/35
5,570,633 A 11/1996 Schultz et al.
5,967,034 A * 10/1999 Baiada ..... 101/216
6,543,355 B1 * 4/2003 Stiel ..... 101/248
7,748,318 B2 * 7/2010 Kruempelmann et al. ... 101/248
2002/0108520 A1 * 8/2002 Kolbe et al. ..... 101/479
2006/0090574 A1 * 5/2006 Moore et al. ..... 73/862.55
2007/0101882 A1 5/2007 Krumpelmann
2008/0141886 A1 6/2008 Whitelaw et al.

FOREIGN PATENT DOCUMENTS

DE 3530024 A1 * 4/1986
DE 19519317 * 11/1996
DE 202007004713 U1 9/2008
EP 1295721 A 3/2003
EP 1916102 A1 4/2008
GB 2114937 A 9/1983
WO WO 2004098890 * 11/2004

* cited by examiner

*Primary Examiner* — Judy Nguyen
*Assistant Examiner* — Ruben Parco, Jr.
(74) *Attorney, Agent, or Firm* — Ostrolenk Faber LLP

(57) ABSTRACT

A method for calibrating a rotary printing press, in which a bearing structure for a printing cylinder is adjusted relative to another component of the printing press, and positions of the bearing structure are measured, including the steps of mounting a calibration tool on a mandrel that is supported in the bearing structure, the calibration tool having at least one contact sensitive switch, moving the bearing structure until the at least one switch contacts the other component, and upon detection of a signal from the at least one switch, storing a measured position of the bearing structure as a reference position.

8 Claims, 6 Drawing Sheets

METHOD AND CALIBRATION TOOL FOR CALIBRATING A ROTARY PRINTING PRESS

BACKGROUND OF THE INVENTION

The invention relates to a method for calibrating a rotary printing press, wherein a bearing structure for a printing cylinder is adjusted relative to another component of the printing press, and positions of the bearing structure are measured.

In a rotary printing press, e.g. a flexographic printing press, the position of the printing cylinder must be adjusted with high precision relative to other machine components, e.g. a central impression cylinder (CI), an anilox roller, the lateral frame of the machine (for adjusting the side register), and the like. In a typical flexographic printing press, a number of colour decks are arranged at the periphery of a CI, and each colour deck comprises a bearing structure for the printing cylinder and another bearing structure for the anilox roller. Each bearing structure comprises two bearing blocks that support the opposite ends of the printing cylinder and the anilox roller, respectively, and are movable relative to the machine frame in a predetermined direction (e.g. horizontal) so as to bring the peripheral surface of the printing cylinder into engagement with a print substrate (web) on the CI and to bring the peripheral surface of the anilox roller into engagement with the printing cylinder. The movements of the bearing blocks are controlled independently of one another by means of servo-motors which also permit to precisely monitor the positions of the bearing blocks. The exact positions which the bearing blocks have to assume during a print process depend among others upon the thickness of a printing sleeve and/or printing plates that are mounted on the printing cylinder.

When the printing press has to be prepared for a new print job, the printing cylinders have to be exchanged. In a known printing press, a hollow-cylindrical adapter which carries the printing plates of a printing sleeve is removably mounted, e.g. hydraulically clamped, on a mandrel that remains in the machine. In order to exchange the adapter, the bearing at one end of the mandrel is removed, so that the adapter can be withdrawn axially from the mandrel. Then, the new adapter, with the printing sleeve or plates carried thereon, is thrust onto the mandrel and is clamped thereon. Then, the bearing that had previously been removed is restored again.

In a start-up phase of the print process, the contact pressure between the printing cylinder and the CI and between the anilox roller and the printing cylinder has to be adjusted with high precision. Conventionally, this is done by first moving the printing cylinder and the anilox roller into predetermined start positions by appropriately controlling the servo-motors for the bearing blocks. Then, the print process is started, and the printing result is monitored and a fine adjustment is performed for optimising the contact pressures. This so-called setting procedure takes a certain amount of time, and, since the quality of the printed images produced during this time will not be satisfactory, a considerable amount of waste is produced.

In the European patent application EP 06 022 135.5, an automated setting procedure has been proposed which aims at reducing or eliminating this waste. According to this proposal, the geometry of the printing cylinder is precisely measured beforehand, for example while the printing cylinder is supported in a mounter which is used for mounting the printing plates thereon. The geometry data of the printing cylinder are then transmitted to a control unit of the printing press and are used for adjusting the bearing blocks precisely to the optimal positions which assure a good print quality from the outset.

In any case, whether the setting procedure is performed automatically or manually by try-and-error, a calibration process is necessary for assuring that the positions of the bearing blocks that are measured and monitored by means of the servo-motors or by means of separate measuring devices reflect the actual physical positions of the axes of the printing cylinder and the anilox roller with high precision. This calibration procedure implies that exact reference positions are determined for each degree of freedom of the bearing structures. When the printing press has once been calibrated and the printing sleeve is exchanged, the reference positions can be used for determining the start positions or set positions of the printing cylinder and the anilox roller that correspond to the thickness of the new printing sleeve.

In a conventional calibration process, a gauge representing the thickness of the printing sleeve or plates is manually inserted between the CI and the printing cylinder, and the printing cylinder is moved against the CI until the gauge is clamped with a suitable force. Then, the actual position of the printing cylinder is measured and stored as the reference position. The same procedure is then repeated for the anilox roller.

This procedure requires a considerable amount of skill and experience and nevertheless has only a low reproducibility, because it is left to the personnel to judge whether the gauge is clamped with suitable pressure.

SUMMARY OF THE INVENTION

It is an object of the invention to propose a more efficient, accurate and reproducible calibration method.

In order to achieve this object, the method according to the invention comprises the steps of:

- mounting a calibration tool on a mandrel that is supported in the bearing structure, said calibration tool having at least one switch,
- moving the bearing structure until the switch detects said other component, and
- upon detection of a signal from the switch, storing the measured position of the bearing structure as a reference position.

The invention further provides a calibration tool and a software product suitable for carrying out this method.

The invention has the advantage that human intervention and, accordingly, the influences of subjective judgements of humans, are reduced to minimum in the calibration process.

More specific embodiments and further developments of the invention are indicated in the dependent claims.

BRIEF DESCRIPTION OF THE DRAWINGS

Preferred embodiments of the invention will now be described in conjunction with the drawings, wherein.

DETAILED DESCRIPTION

Figure 1:
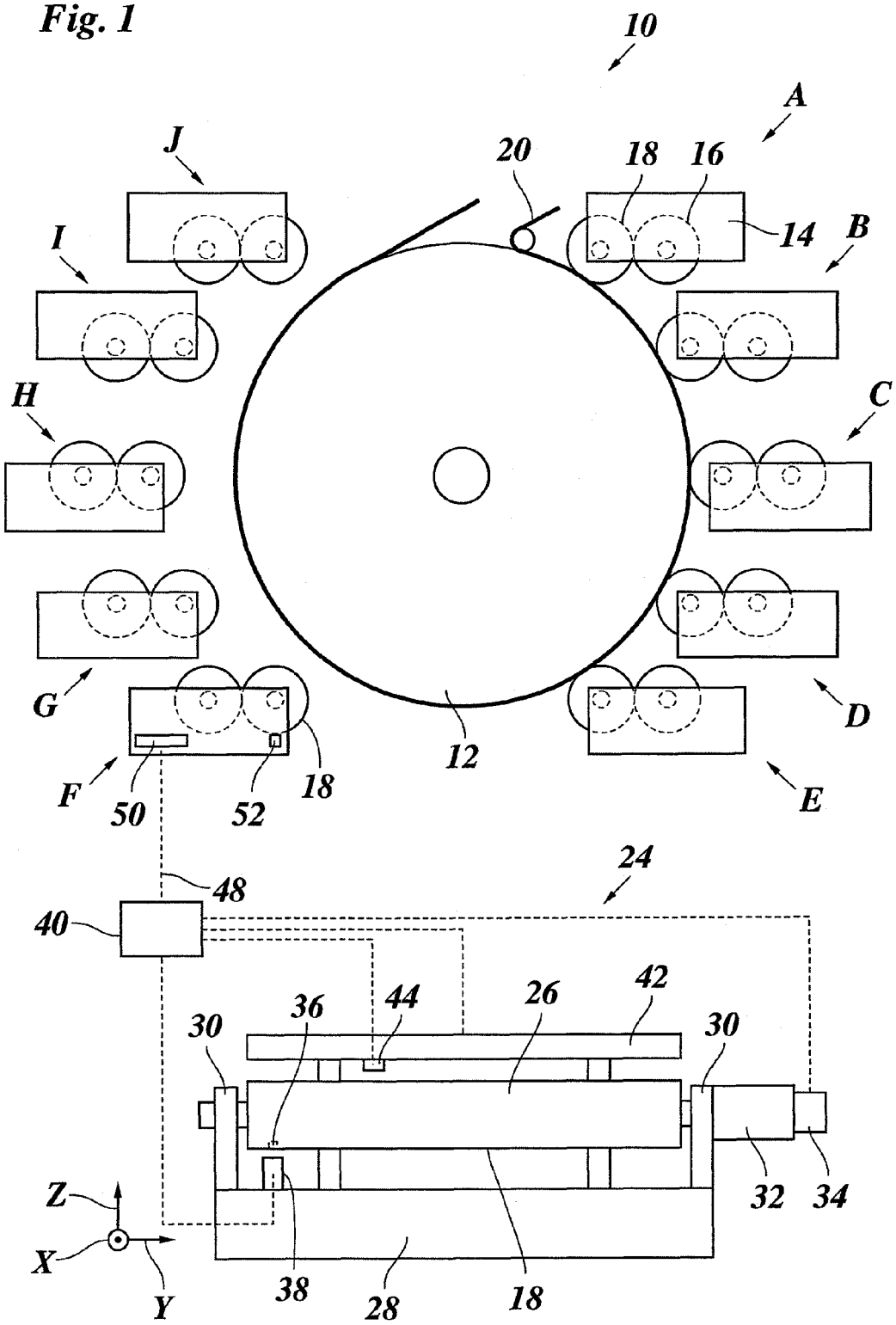
FIG. 1 is a schematic view of a rotary printing press and an associated preparation rack.

As an example of a printing press to which the invention is applicable, FIG. 1 shows a known flexographic printing press having a central impression cylinder (CI) 12 and ten colour decks A-J arranged around the periphery thereof. Each colour deck comprises a frame 14 which rotatably and adjustably supports an anilox roller 16 and a printing cylinder 18. As is generally known in the art, the anilox roller 16 is inked by means of an ink fountain and/or a doctor blade chamber (not shown) and may be adjusted against the printing cylinder 18, so that the ink is transferred onto the peripheral surface of the printing cylinder 18 carrying a printing pattern.

A web 20 of a print substrate is passed around the periphery of the CI 12 and thus moves past each of the colour decks A-J when the CI rotates.

In FIG. 1, the colour decks A-E are shown in the operative state. In this state, the anilox rollers 16 and the printing cylinders 18 are driven to rotate with a peripheral speed that is identical with that of the CI 12, and the printing cylinder 18 is adjusted to the web 20, so that an image corresponding to the respective printing pattern is printed onto the web 20. Each of the colour decks A-E operates with a specific type of ink so that corresponding colour separation images of a printed image are superposed on the web 20 when it passes through the nips formed between the CI 12 and the various printing cylinders 18 of the successive colour decks.

In the condition shown in FIG. 1, the other five colour decks F-J are not operating, and their printing cylinders are shifted away from the web 20. While the machine is running, these colour decks F-J may be prepared for a subsequent print job by exchanging the printing cylinders 18 and, as the case may be, also the anilox rollers 16.

FIG. 1 further shows a schematic front view of a so-called mounter 24, i.e. a rack that is used for preparing a printing cylinder 18 before the same is mounted in one of the colour decks, e.g., the colour deck F. In the example shown, it is assumed that the printing cylinder 18 is of a type carrying one or more printing plates 26 carrying a printing pattern on their outer peripheral surface. As is generally known in the art, the printing cylinder may take the form of a sleeve that is hydraulically or pneumatically clamped on a mandrel of the mounter and the printing press, respectively. The mounter 24 is particularly used for mounting the printing plates 26 on the printing cylinder sleeve, e.g. by means of an adhesive.

The mounter 24 has a base 28 and two releasable bearings 30 in which the opposite ends of the printing cylinder 18 are rotatably supported. As an alternative, the mounter may have one releasable bearing and a fixed base that extends to enable diameter changes of different size mounting mandrels. A drive motor 32 is arranged to be coupled to the printing cylinder 18 to rotate the same, and an encoder 34 is coupled to the drive motor 32 for detecting the angular position of the printing cylinder 18.

A reference mark 36, e.g. a magnet, is embedded in the periphery of the printing cylinder 18, and a detector 38 capable of detecting the reference mark 36 is mounted on the base 28 in a position corresponding to the axial position of the reference mark. The detector 38 may for example be a 3-axes hall detector capable of accurately measuring the position of the reference mark 36 in a 3-dimensional co-ordinate system having axes X (normal to the plane of the drawing in FIG. 1), Y (in parallel with the axis of rotation of the printing cylinder 18) and Z (vertical in FIG. 1).

When the printing cylinder 18 is rotated into the position shown in FIG. 1, where the reference mark 36 faces the detector 38, the detector 38 measures an offset of the reference mark 36 relative to the detector 38 in Y-direction as well as an offset in X-direction. This offset in X-direction is determined by the angular position of the printing cylinder 18. Thus, even when the reference mark 36 is not exactly aligned with the detector 38, it is possible to derive a well defined Y-position and a well defined angular ($\phi$) position which may serve as a reference point for defining a cylindrical $\phi$-Y-R coordinate system that is fixed relative to the printing cylinder 18 (the R-coordinate being the distance of a point from the axis of rotation of the printing cylinder, as defined by the bearings 30). The position data defining this reference point are stored in a control unit 40 of the mounter 24.

The mounter 24 further comprises a rail 42 that is mounted on the base 28 and extends along the outer surface of the printing cylinder 18 in Y-direction. A laser head 44 is guided on the rail 42 and may be driven to move back and forth along the rail 42 so as to scan the surface of the printing cylinder 18 and, in particular, the surfaces of the printing plates 26. The rail 42 further includes a linear encoder which detects the Y-position of the laser head 44 and signals the same to the control unit 40. When the printing cylinder 18 is rotated, the encoder 34 counts the angular increments and signals them to the control unit 40, so that the control unit 40 can always determine $\phi$ and Y-coordinates of the laser head 44 in the cylindrical coordinate system that is linked to the reference mark 36 of the printing cylinder.

The laser head 44 uses laser triangulation and/or laser interferometry techniques for measuring the height of the surface point of the printing cylinder 18 (or printing plate 26) that is located directly underneath the current position of the laser head. As an alternative, a mechanical, e.g. roller-type height detector may be used instead of the laser head. The height determined in this way can be represented by the R-coordinate in the cylindrical coordinate system. Thus, by rotating the printing cylinder 18 and moving the laser head 44 along the rail 42, it is possible to scan the entire peripheral surface of the printing cylinder 18 and to capture a height profile or topography of that surface with an accuracy that may be as high as 1-2 μm, for example. To this end, the mounter may be calibrated to map inherent deviations of the rail 42, which will then be combined in the control unit 40 with the readings from the laser head 44 so as to establish a more accurate topography.

In this way, the exact geometrical shape of the printing cylinder 18 (including the printing plates) can be determined with high accuracy in the control unit 40. In particular, it is possible to detect whether the surface of the printing cylinder has a circular or rather a slightly elliptic cross-section. If the cylinder is found to have an elliptic cross section, the azimuth angle of the large axis of the ellipse can be determined. Likewise, even if the cross section of the surface of the printing cylinder is a perfect circle, it is possible to detect whether the centre of this circle coincides with the axis of rotation that is defined by the bearings 30. If this is not the case, the amount of the offset and its angular direction can also be detected and recorded. In principle, all this can be done for any Y-position along the printing cylinder 18. Moreover, it is possible to detect whether the diameter of the printing cylinder 18 varies in Y-direction. For example, it can be detected whether the printing cylinder has a certain conicity, i.e., whether its diameter slightly increases from one end to the other. Similarly, it can be detected whether the printing cylinder bulges outwardly (positive crown) or inwardly (negative crown) in the central portion. In summary, it is possible to gather a number of parameters that indicate the average diameter of the printing cylinder 18 as well as any possible deviations of the shape of the peripheral surface of the printing cylinder from a perfect cylindrical shape.

When the printing cylinder 18 has been scanned in the mounter 24, it is removed from the mounter so that it may be inserted in one of the colour decks of the printing press 10. When, for example, the printing cylinder that has been removed from the mounter 24 is to replace the printing cylinder in the colour deck F, the topography data detected by means of the laser head 44 and stored in the control unit 40 are transmitted through any suitable communication channel 48 to an adjustment control unit 50 of that colour deck.

As is further shown in FIG. 1, each colour deck comprises a detector 52 for detecting the reference mark 36 of the printing cylinder mounted in that colour deck. Thus, by detecting the position of the reference mark 36 with the detector 52 after the printing cylinder has been mounted in the colour deck F, it is possible to transform the topography data obtained from the mounter 24 into a local coordinate system of the colour deck. Then, the position of the printing cylinder 18 in the colour deck F may be adjusted on the basis of these data, as will now be explained in conjunction with FIG. 2.

Figure 2:
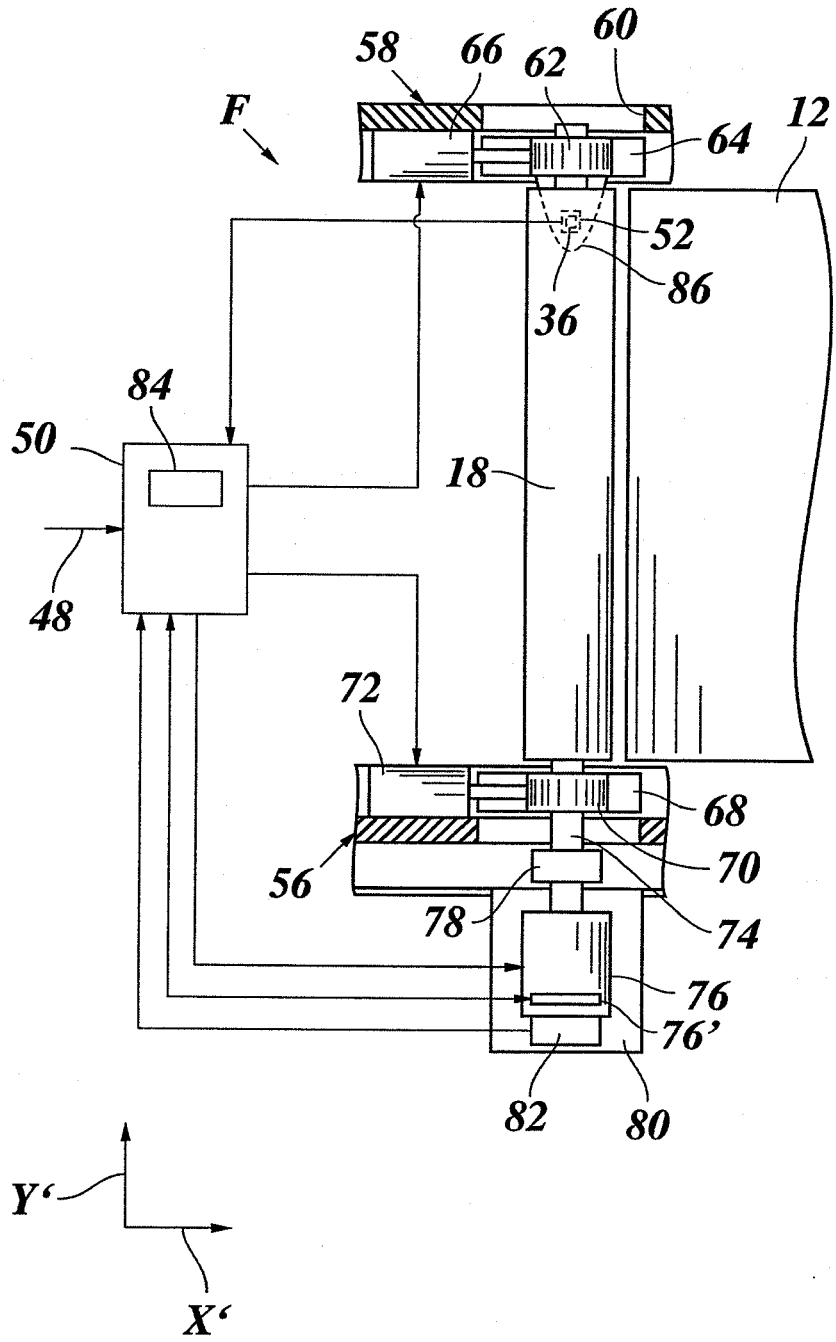
FIG. 2 is a schematic horizontal cross-section showing essential parts of an individual colour deck in the printing press shown in FIG. 1.

FIG. 2 shows only a peripheral portion of the CI 12 as well as certain portions of the colour deck F which serve to rotatably and adjustably support the printing cylinder 18. These portions of the colour deck comprise stationary frame members 56, 58 on the drive side and the operating side of the printing press 10, respectively. The frame member 58 on the operating side has a window 60 through which, when the printing cylinder is to be exchanged, the old printing cylinder is removed and the new one is inserted. In practice, rather than exchanging the printing cylinder 18 in its entirety, it may be convenient to exchange only the printing cylinder sleeve that is air-mounted on a cylinder core or mandrel, as is well known in the art.

The frame member 58 carries a releasable and removable bearing 62 that supports one end of the printing cylinder 18. This bearing 62 is slidable towards and away from the CI 12 along a guide rail 64, and a servo motor or actuator 66 is provided for moving the bearing 62 along the guide rail 64 in a controlled manner and for monitoring the positions of the bearing 62 with high accuracy.

The frame member 56 on the drive side of the printing press has a similar construction and forms a guide rail 68 that supports a bearing 70 and a servo motor or actuator 72. Here, however, an axle 74 of the printing cylinder extends through a window of the frame member 56 and is connected to an output shaft of a drive motor 76 through a coupling 78. The drive motor 76 is mounted on a bracket 80 that is slidable along the frame member 56, so that the drive motor may follow the movement of the bearing 70 under the control of the actuator 72. Thus, the position of the printing cylinder 18 relative to the CI 12 along an axis X' (defined by the guide rails 64, 68) may be adjusted individually for either side of the printing cylinder. In this way, it is possible to set the pressure with which the printing cylinder 18 presses against the web on the CI 12 and also to compensate for a possible conicity of the printing cylinder.

The axle 74 of the printing cylinder 18 is axially slidable in the bearings 62, 70 (in the direction of an axis Y') and the drive motor 76 has an integrated side register actuator 76' for shifting the printing cylinder in the direction of the axis Y'.

Further, the drive motor 76 includes an encoder 82 for monitoring the angular position of the printing cylinder 18 with high accuracy.

The detector 52 which may have a similar construction as the detector 38 in the mounter 24, is mounted on a bracket 86 that projects from a part of the bearing 62 that can be tilted away when the printing cylinder is to be removed. Thus, the detector 52 is held in such a position that it may face the reference mark 36 on the printing cylinder.

When the printing cylinder 18 is mounted in the colour deck F, the drive motor 76 is held at rest in a predetermined home position, and the coupling 78 may comprise a conventional notch and key mechanism (not shown) which assures that the reference mark 36 will roughly be aligned with the detector 52. Then, the precise offset of the reference mark 36 relative to the detector 52 in Y'-direction and the precise angular offset are measured in the same way as has been described in conjunction with the detector 38 of the mounter. The measured offset data are supplied to the adjustment control unit 50 which also receives data from the encoder 82 and the side register actuator 76'. These data permit to determine the angular position and the Y'-position of the printing cylinder 18 in a machine coordinate system.

By reference to the topography data delivered via the communication channel 48 and by reference to the Y' position provided by the side register actuator 76' and the offset data provided by the detector 52, the control unit 50 calculates the Y' position of the printing pattern on the printing plates 26 in the machine coordinate system and then controls the actuator 76' to precisely adjust the side register.

Then, before a print run with the new printing cylinder 18 starts, the drive motor 76 is driven to rotate the printing cylinder 18 with a peripheral speed equal to that of the CI 12, and the angular positions of the printing cylinder 18 are monitored on the basis of the data supplied by the encoder 82. By reference to the topography data and the offset data from the detector 52, the control unit 50 calculates the actual angular positions of the printing pattern on the printing plates 26 and advances or delays the drive motor 76, thereby to adjust the longitudinal register.

The control unit 50 further includes a memory 84 which stores calibration data. These calibration data include, for example, the X' position of the CI 12 relative to the printing cylinder 18, a reference for the side register of the printing cylinder, and the like. Since the X'-direction defined by the guide rails 64, 68 is not necessarily normal to the surface of the CI 12 at the nip formed with the printing cylinder 18, the calibration data may also include the angle formed between the normal on the surface of the CI and the X'-di-rection.

A method for obtaining such calibration data will now described in conjunction with FIGS. 3 to 8.

Figure 3:
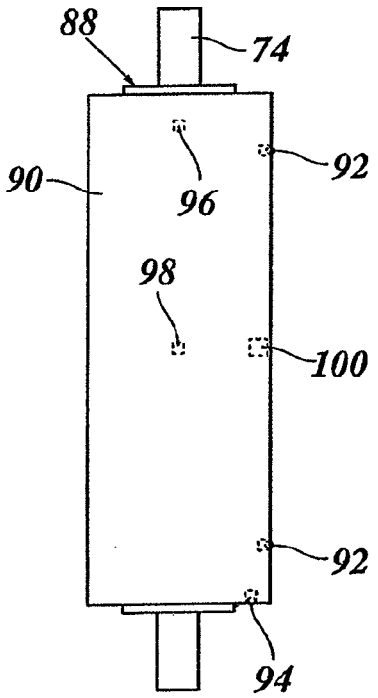
FIGS. 3, 3A are top plan views of mandrels with calibration tools mounted thereon.
Figure 3A:
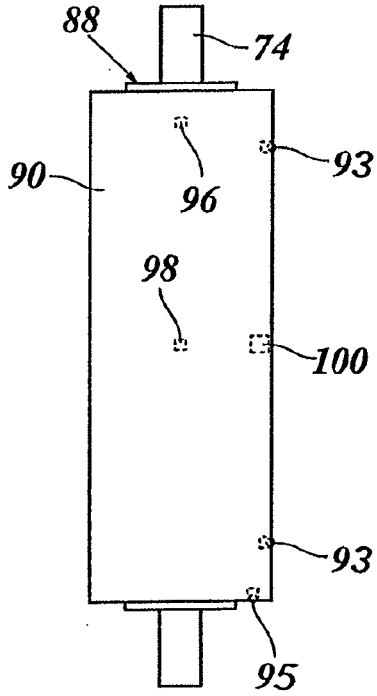

FIG. 3 shows a mandrel 88 that forms part of the printing cylinder 18 and is supported in the bearings 62, 70. During the print process, this mandrel carries an adapter sleeve (not shown) that carries, for example, an air-mounted printing sleeve with the printing pattern or printing plates thereon. In FIG. 3, however, this printing adapter has been replaced by a calibration tool 90 that has the same dimensions as a typical printing adapter and can hydraulically be clamped on the mandrel 88 in the same manner as a normal printing adapter. The calibration tool 90 is made of a rigid material which has a high shape- and dimensional stability and a low thermal expansion coefficient. A particular preferred material is a carbon fibre composite with carbon fibres embedded in a resin matrix. In the vicinity of each end of the calibration tool 90, a precision switch 92 is embedded therein such that a contact sensitive part of the switch is exposed in the peripheral surface of the tool. Another precision switch 94 is arranged in an end face of the tool 90. Instead of contact-sensitive switches, it is also possible to use distance detectors 93, 95, as shown in FIG. 3A, that are capable of detecting an object in a short distance from the tool and to measure that distance exactly.

Further, a reference mark 96 corresponding to the reference mark 36 of the printing cylinder shown in FIG. 2 is embedded in the tool 90.

In a central part of the calibration tool 90, an inclinometer 98 and a magnetic position detector 100 comparable to the detector 38 in FIG. 1 are embedded in the tool with an angular offset of precisely 90°.

Each of the precision switches 92, 94, the inclinometer 98 and the detector 100 are capable of communicating with the control unit 50 (FIG. 2), preferably through a wireless communication channel. As an alternative, they may be connected to the control unit 50 via wirelines and sliding contacts in the bearings.

Figure 4:
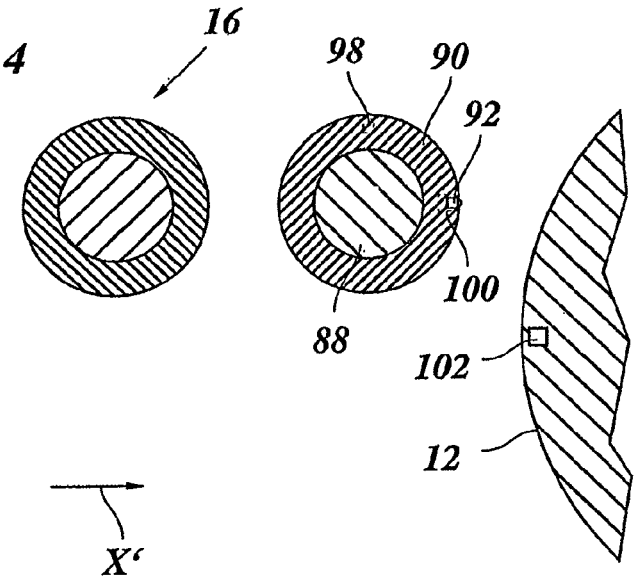
FIGS. 4-7 are cross-sectional views of the calibration tool, an anilox roller and a part of a CI in subsequent steps of a calibration procedure.

In FIG. 4, the calibration tool 90, the anilox roller 16 and a part of the CI 12 are shown in a cross-sectional view. When a calibration process is to be performed, the calibration tool 90 is rotated into a position in which the inclinometer 98 faces upwards. The inclinometer 98 is of a commercially available type and is capable of detecting inclinations in both, the left/right direction in FIG. 4 and the direction normal to the plane of the drawing with an accuracy as high as 0.1 arc seconds, for example. The axis of the inclinometer is exactly coincident with the radial direction of the tool 90. On the basis of the inclination signals delivered by the inclinometer 98, the tool 90 is rotated into a position in which the inclination (in left/right direction) is exactly zero (vertical), and the corresponding angular position of the tool 90, detected by the encoder 82, is stored as an angular reference position for the drive motor 76 and the mandrel 88. In this position, the switches 92 face the CI 12. They are however vertically offset from the axis of the CI, depending on the colour deck to which the mandrel 88 belongs.

Figure 5:
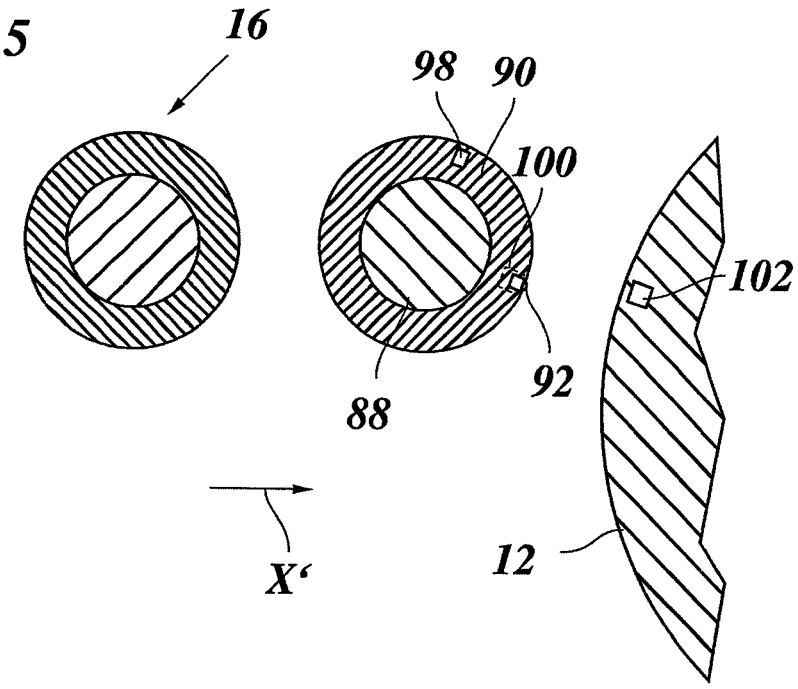

Then, as is shown in FIG. 5, the drive motor 76 is driven to rotate the tool 90 into a position in which the switches 92 are located on the line of contact where the tool 90 will meet the peripheral surface of the CI 12 once the tool 90 is driven in X'-direction against the CI. The necessary angle of rotation can roughly be determined on the basis of the height of the pertinent colour deck relative to the CI.

Figure 6:
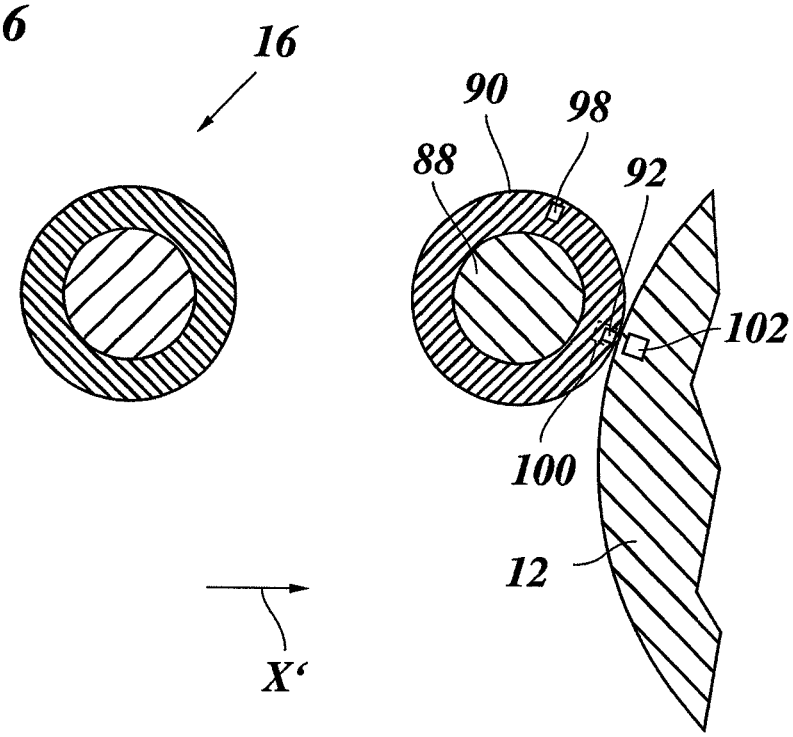

In the next step, shown in FIG. 6, the actuators 66 and 72 (FIG. 2) are operated to move the tool 90 against the CI 12, until the precision switches 92 detect the peripheral surface of the CI. The precision switches 92 are of a commercially available type (e.g. MY-COM switches) and are capable of detecting contact with the CI with a positional accuracy of 1 μm. As soon as the switches 92 send detection signals to the control unit 50, the actuators 66, 72 are stopped, and the positions of the actuators, corresponding to the X'-position of the mandrel 88, are recorded as reference positions.

Theoretically, the detection signals of both switches 92 should be received simultaneously. However, slight differences may occur when the axis of the mandrel 88 is not exactly parallel with the axis of the CI 12 or, more precisely, the corresponding part of the peripheral surface of the CI. Since the actuators 66 and 72 for the opposite ends of the mandrel 88 are controlled independently from one another, it is possible to detect independent reference positions in which both switches 92 engage the peripheral surface of the CI.

In the position shown in FIG. 6, the detector 100 in the tool 90 faces the peripheral surface of the CI. Further, the CI 12 has been rotated into a position in which a magnetic reference mark 102 that is embedded in the peripheral surface thereof should face the detector 100. The corresponding angular position of the CI can be calculated from the height of the pertinent colour deck. The detector 100 is capable of detecting an offset of the reference mark 102 in circumferential direction of the CI 12, and in combination with the known radii of the tool 90 and the CI 12, this offset can be transformed into an angular offset of the tool 90 and/or the CI. In conjunction with the known angular positions of the tool 90 and the CI 12 in the condition shown in FIG. 6, this angular offset permits to relate the angular position of the mandrel 88 exactly to the angular position of the CI 12, thereby to provide a precise reference for the longitudinal register in a later printing process. When the thickness of the printing tool is different from that of the calibration tool 90, a corresponding correction of the reference can easily be calculated.

Moreover, since the inclinometer 98 has been oriented exactly vertical in the position shown in FIG. 4, the angle by which the tool has been rotated from the position of FIG. 4 to that of FIG. 6, in combination with the angular offset detected by the detector 100, permits to determine a possible inclination of the X'-direction, i.e. the direction of the guide rails 64, 68.

In a modified embodiment, it would be possible to employ two pairs of detectors 100 and reference marks 102 near opposite ends of the tool 90 and the CI, and it would then be possible to detect the inclination of each of the guide rails 64 and 68 individually.

Moreover, since the inclinometer 98 is a two-dimensional inclinometer, it is also possible in the position shown in FIG. 4, to detect a possible inclination of the axis of the mandrel 88. In principle, this inclination can be measured for any position of the mandrel 88 in X'-direction.

Figure 7:
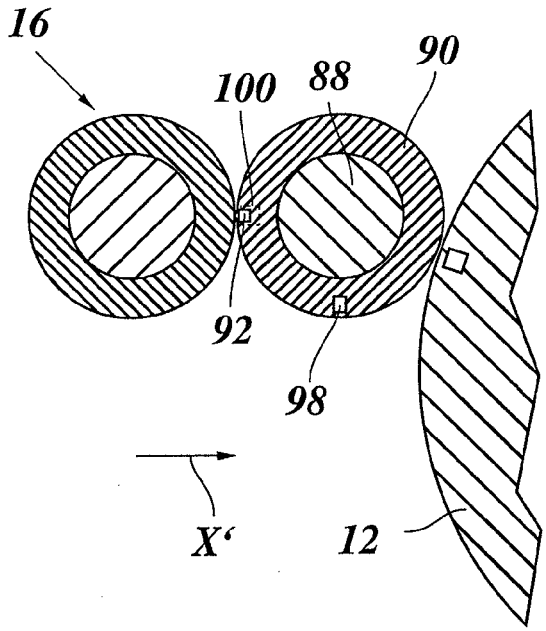
Figure 8A:
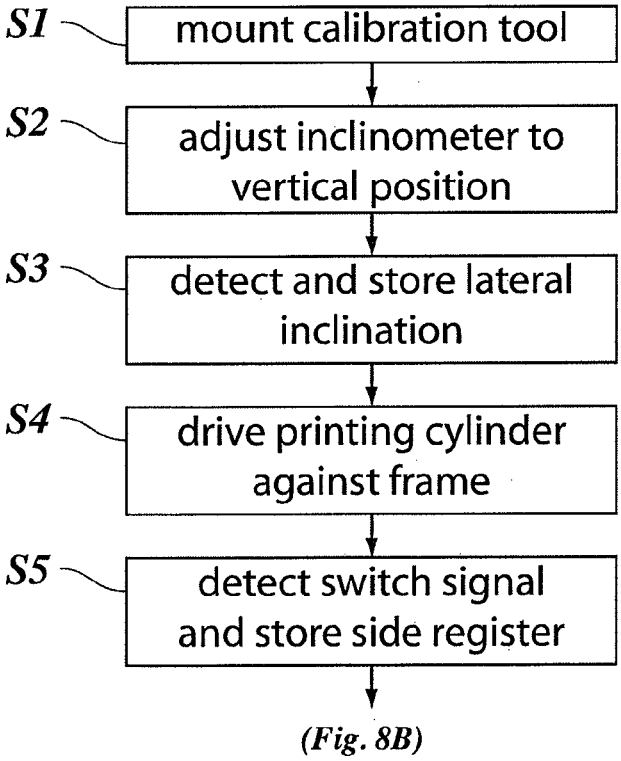
FIGS. 8A,B show a block diagram illustrating a method according to the invention.
Figure 8B:
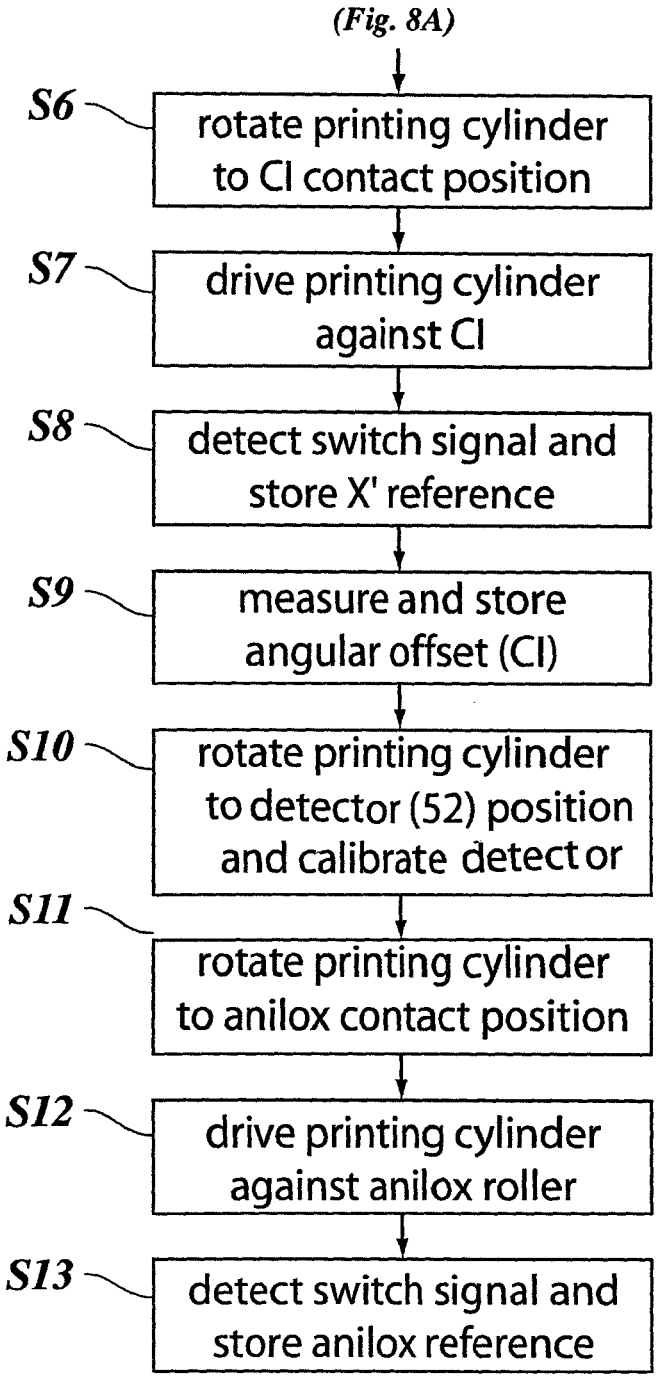

FIG. 7 illustrates a condition in which the tool 90 has been rotated into a position in which a radius from the central axis of the mandrel 88 to the switches 92 is exactly parallel with the X'-direction, and the switches face the anilox roller 16. This rotation may optionally be performed after the mandrel 88 has slightly been withdrawn from the CI 12 so as to avoid friction. Then, as has also been shown in FIG. 7, the anilox roller 16 is moved in X'-direction against the tool 90 until the switches 92 detect contact between the anilox roller and the calibration tool, thereby to detect a reference position for the anilox roller 16 and X'-direction. Again, independent reference positions are detected for both ends of the anilox roller. Of course, it would also be possible to move the calibration tool 90 until it abuts against the anilox roller 16.

In the condition shown in FIG. 4, the reference mark 96 on the calibration tool 90 will be exactly in the top position and will roughly face the detector 52 (FIG. 2). Thus, by measuring an offset between the reference mark 96 of the tool 90 and the detector 52 (preferably in two dimensions), it is possible to calibrate the position of the detector 52.

If necessary, it would also be possible to provide a magnetic reference mark in the anilox roller 16, so that the angular position of the anilox roller could be calibrated by means of the detector 100.

Of course, instead of providing the detector 100 in the calibration tool 90 and the magnetic reference mark 102 on the CI, it would also be possible to provide a reference mark on the calibration tool and a detector on the CI.

The switch 94 that has been shown in FIG. 3 may be used for calibrating the side register actuator 76'. To that end, the mandrel is displaced axially by means of the drive motor 76, and the axial position is monitored with the side register actuator 76'. When the switch 94 hits a stationary part of the machine frame, e.g. the frame member 56 or a part of the bearing 70, the axial position of the mandrel is stored as a reference for the side register actuator 76'.

The essential steps of the calibration processes that have been described above are summarised in a flow diagram in FIGS. 8A and 8B.

In step S1, the calibration tool 90 is mounted on the mandrel 88 of the colour deck to be calibrated.

Then, in step S2, the inclinometer is adjusted to the vertical position, and, in step S3, the lateral inclination, i.e. the inclination of the axis of the mandrel 88 is measured and stored.

Then, in step S4, the printing cylinder is driven against the frame member 56, and the side register is detected and stored in step S5.

In step S6 (FIG. 8B), the printing cylinder or rather the mandrel 86 with the calibration tool 90, is rotated into the position of FIG. 5 where the switches 92 are ready to detect the surface of the CI. In step S7, the printing cylinder is driven against the CI, and the reference positions in X'-direction, for both sides of the printing cylinder, are detected in step S8.

In step S9, the angular offset of the CI is measured by means of the detector 100 and reference mark 102.

Then, in step S10, the reference mark 96 on the calibration tool 90 is rotated to the position of the detector 52 to calibrate the position of this detector relative to the axis defined by the bearings 62, 70.

In step S11, the printing cylinder (with the calibration tool) is rotated into the position in which the switches 92 may contact the anilox roller, and the calibration tool is driven against the anilox roller (or vice versa), and the reference positions of the anilox roller in X'-direction are detected and stored in steps S12 and S13.

This procedure will be repeated for each of the colour decks A-J. Then, since the angular reference positions of all printing cylinders are related to the angular positions of the CI 12, all colour decks are calibrated to provide an exact longitudinal register in the printing process.

Moreover, if desired, the steps S7 and S8 may be repeated for the same colour deck but for different angular positions of the CI, so that any deviations of the CI from the perfect cylindrical shape can be detected.

In a modified embodiment, it would also be possible, to provide more than two precision switches 92 along the longitudinal axis of the calibration tool 90 so as to detect the profile (or crown) of the CI with higher resolution. If the CI is equipped with a system for varying the diameter and/or crown thereof (e.g. by means of thermal expansion as described in DE 20 2007 004 713) these means and the detection results obtained with the switches 92 may be used to "shape" the CI as desired.

A method equivalent to the one that has been described here for calibrating the printing press can also be employed for calibrating the mounter 24 that has been shown in FIG. 1. In this case, the calibration tool 90 will be mounted on a mandrel of the mounter 24, and, after inserting gauges between the periphery of the tool 90 and the guide rail 42, the guide rail will (manually) be adjusted against the calibration tool until the switches 92 produce a detection signal.

What is claimed is:

1. A method for calibrating a position of a printing cylinder in a rotary printing press, wherein a bearing structure for the printing cylinder is adjusted relative to another component of the printing press, and positions of the bearing structure are measured, the printing cylinder comprising a mandrel that is supported in the bearing structure, and a printing adapter removably mounted on the mandrel, the method comprising the steps of:

replacing a printing adapter by mounting a calibration tool on the mandrel, the calibration tool having at least one sensor embedded in the calibration tool such that a sensitive part of the at least one sensor is exposed in a peripheral surface of the calibration tool, detecting an angular reference position of the calibration tool by an inclinometer provided in the calibration tool, rotating the calibration tool into an angular position in which the sensitive part of the at least one sensor will contact or detect proximity to a peripheral surface of the other component when the calibration tool is moved into contact with or proximity to the other component, moving the bearing structure until the at least one sensor detects contact with or proximity to the other component, and sends a signal to a controller, upon detection of the signal from the at least one sensor, storing a measured position of the bearing structure as a reference position, and replacing the calibration tool by a printing adapter and using the stored position of the bearing structure to position the printing cylinder in the printing press.

2. The method according to claim 1, wherein the other component of the printing press is one of:

a central impression cylinder and an anilox roller.

3. The method according to claim 2, further comprising the steps of:

moving opposite ends of the calibration tool against one of:

the central impression cylinder and the anilox roller independently of one another, and storing independent reference positions on the basis of sensor signals from two sensors of said at least one sensor arranged at opposite ends of the calibration tool.

4. The method according to claim 2, further comprising the steps of:

when the calibration tool engages one of the central impression cylinder and the anilox roller, detecting an angular position of one of the central impression cylinder and the anilox roller and establishing a relation between the angular position of one of the central impression cylinder and the anilox roller and an angular position of the calibration tool by detecting an offset between a reference mark and a mark detector that are provided on a peripheral surface of one of the central impression cylinder and the anilox roller and the peripheral surface of the calibration tool, respectively.

5. The method according to claim 1, wherein at least one sensor is mounted in an end face of the calibration tool and the other component of the printing press is a frame member.

6. The method according to claim 1, for a printing press having a detector arranged for detecting a reference mark on the printing cylinder, comprising a step of detecting a reference mark on the calibration tool with said detector.

7. The method according to claim 1, wherein the at least one sensor is at least one contact-sensitive switch.

8. The method according to claim 1, wherein the at least one sensor is at least one distance detector.

* * * * *